US008995889B2

(12) United States Patent
Leemhuis

(10) Patent No.: US 8,995,889 B2
(45) Date of Patent: Mar. 31, 2015

(54) TONER ANTI-BRIDGING AGITATOR FOR AN IMAGE FORMING DEVICE

(75) Inventor: James Richard Leemhuis, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 131 days.

(21) Appl. No.: 13/611,104

(22) Filed: Sep. 12, 2012

(65) Prior Publication Data

US 2014/0072348 A1 Mar. 13, 2014

(51) Int. Cl.
*G03G 15/08* (2006.01)

(52) U.S. Cl.
CPC .... *G03G 15/0865* (2013.01); *G03G 2215/0827* (2013.01)
USPC ..... 399/263

(58) Field of Classification Search
CPC ..... G03G 2215/085; G03G 15/0839; G03G 15/0832; G03G 2215/0827; G03G 15/0887; G03G 15/0891; G03G 15/0865; G03G 2215/0822
USPC ..... 399/263, 358
See application file for complete search history.

(56) References Cited

U.S. PATENT DOCUMENTS

| | | | | |
|---|---|---|---|---|
| 2004/0126143 | A1* | 7/2004 | Blanck et al. | 399/260 |
| 2006/0018690 | A1* | 1/2006 | Blair et al. | 399/358 |
| 2007/0092301 | A1* | 4/2007 | Bessette | 399/254 |
| 2010/0143011 | A1* | 6/2010 | Tawada | 399/358 |

OTHER PUBLICATIONS

U.S. Appl. No. 13/564,037, filed Aug 1, 2012.
Prosecution history of U.S. Appl. No. 13/564,037 including Non-Final Office Action dated Apr. 11, 2014.

* cited by examiner

*Primary Examiner* — David Gray
*Assistant Examiner* — Sevan A Aydin
(74) *Attorney, Agent, or Firm* — Justin M Tromp

(57) ABSTRACT

A removable unit for an electrophotographic image forming device according to one example embodiment includes a housing having an inner volume forming a toner reservoir and a channel for accumulating toner. The removable unit further includes an auger for advancing toner within the channel. The auger has a rotational axis and a flight. An agitator is pivotally mounted within the toner reservoir. The agitator has at least one agitating member extending near the auger and a cam surface operatively connected to the at least one agitating member and positioned to engage the auger. When the auger rotates, the flight of the auger engages the cam surface causing pivotal movement of the agitator to move the at least one agitating member to agitate toner accumulated near the auger.

10 Claims, 11 Drawing Sheets

TONER ANTI-BRIDGING AGITATOR FOR AN IMAGE FORMING DEVICE

CROSS REFERENCES TO RELATED APPLICATIONS

This application is related to U.S. patent application Ser. No. 13/564,037, filed Aug. 1, 2012, entitled "Toner Anti-Bridging Agitator for an Imaging Device."

BACKGROUND

1. Field of the Disclosure

The present disclosure relates generally to electrophotographic image forming devices and more particularly to an anti-bridging agitator for an image forming device.

2. Description of the Related Art

In toner cartridge design, it is now common to separate components having a longer life from those having a shorter life into separate replaceable units. Relatively longer life components such as a developer roll, a toner adder roll, a doctor blade and a photoconductive drum are positioned in one replaceable unit (an "imaging unit"). The image forming device's toner supply, which is consumed relatively quickly in comparison with the components housed in the imaging unit, is provided in a reservoir in a separate replaceable unit in the form of a toner cartridge that mates with the imaging unit. In this configuration, the number of components housed in the toner cartridge is reduced in comparison with traditional toner cartridges.

To deliver toner from the toner cartridge to the imaging unit, an auger in the toner cartridge may be used to feed toner from an exit port on the toner cartridge into an entrance port on a developer unit of the imaging unit. The developer unit may include a second auger in proximity to the entrance port that disperses the toner within the developer unit. While the toner cartridge and the imaging unit are in high temperature storage or shipping conditions, toner stored therein may tend to clump together. When the toner cartridge and imaging unit are then installed in an image forming device, the clumped toner may form a bridge that disrupts or blocks toner flow from the toner cartridge to the imaging unit. Accordingly, a mechanism for keeping the pathway from the toner cartridge to the imaging unit free from packed toner is desired in order to improve toner delivery.

SUMMARY

A removable unit for an electrophotographic image forming device according to one example embodiment includes a housing having an inner volume forming a toner reservoir and a channel for accumulating toner. The removable unit further includes an auger for advancing toner within the channel. The auger has a rotational axis and a flight. An agitator is pivotally mounted within the toner reservoir. The agitator has at least one agitating member extending near the auger and a cam surface operatively connected to the at least one agitating member and positioned to engage the auger. When the auger rotates, the flight of the auger engages the cam surface causing pivotal movement of the agitator to move the at least one agitating member to agitate toner accumulated near the auger.

A toner conveyance assembly for an electrophotographic image forming device according to one example embodiment includes a channel for accumulating toner and an auger for advancing toner within the channel. The auger has a rotational axis and a flight. An agitator has at least one agitating member extending near the auger and a cam surface operatively connected to the at least one agitating member and positioned to engage the auger. When the auger rotates, the flight of the auger engages the cam surface causing pivotal movement of the agitator to move the at least one agitating member to agitate toner accumulated near the auger.

An agitator assembly for a toner delivery device according to one example embodiment includes a base for mounting on an inner surface of a housing of the toner delivery device. A shaft is pivotally mounted on the base. At least one agitating member extends from the shaft. A cam surface is connected to the shaft and positioned to engage an auger of the toner delivery device when the auger rotates causing pivotal movement of the shaft to move the at least one agitating member to agitate toner accumulated near the auger.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
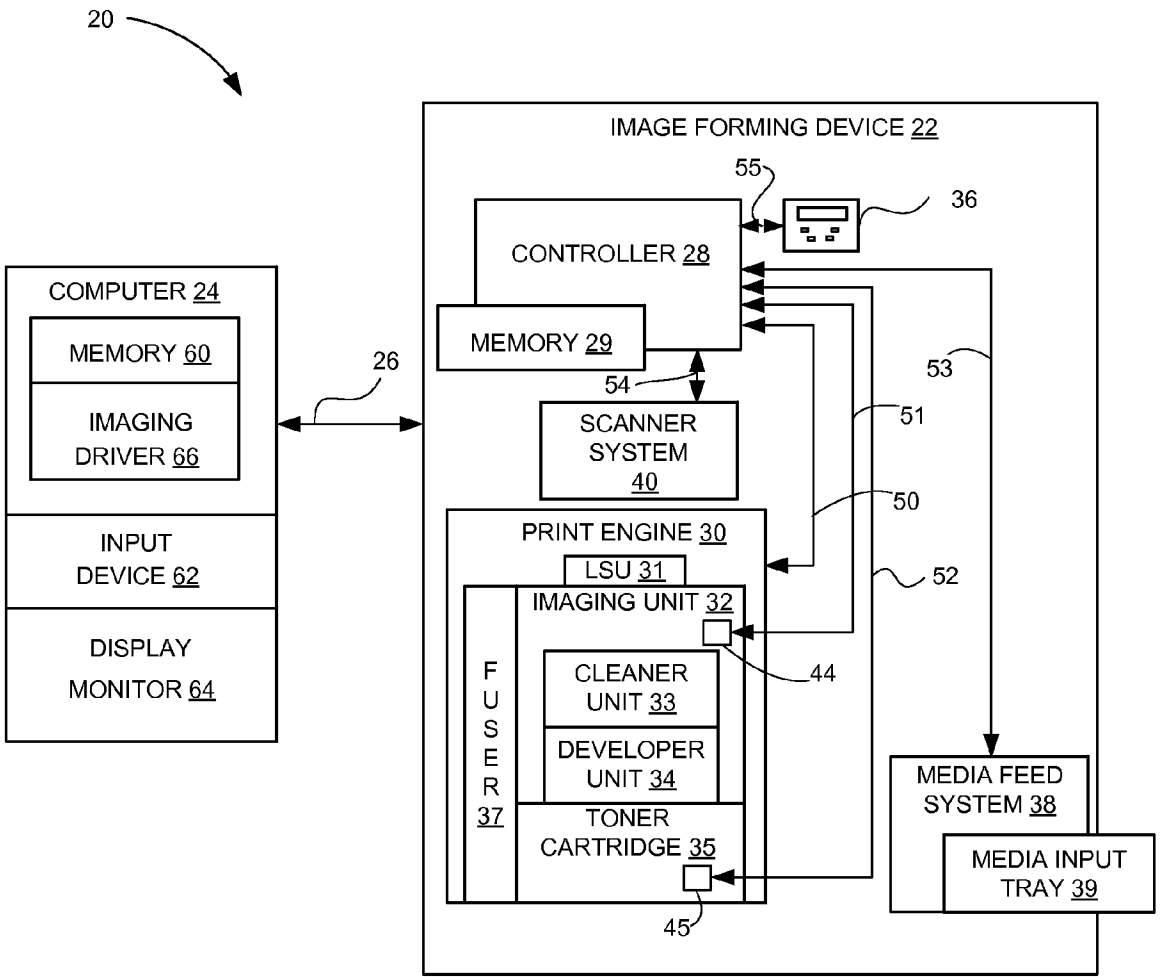
FIG. 1 is a block diagram of an imaging system according to one example embodiment.

Referring now to the drawings and more particularly to FIG. 1, there is shown a block diagram depiction of an imaging system 20 according to one example embodiment. Imaging system 20 includes an image forming device 22 and a computer 24. Image forming device 22 communicates with computer 24 via a communications link 26. As used herein, the term "communications link" generally refers to any structure that facilitates electronic communication between multiple components and may operate using wired or wireless technology and may include communications over the Internet.

In the example embodiment shown in FIG. 1, image forming device 22 is a multifunction machine (sometimes referred to as an all-in-one (AIO) device) that includes a controller 28, a print engine 30, a laser scan unit (LSU) 31, an imaging unit 32, a toner cartridge 35, a user interface 36, a media feed system 38 and media input tray 39 and a scanner system 40. Image forming device 22 may communicate with computer 24 via a standard communication protocol, such as for example, universal serial bus (USB), Ethernet or IEEE 802.xx. Image forming device 22 may be, for example, an electrophotographic printer/copier including an integrated scanner system 40 or a standalone electrophotographic printer.

Controller 28 includes a processor unit and associated memory 29 and may be formed as one or more Application Specific Integrated Circuits (ASICs). Memory 29 may be any volatile or non-volatile memory or combination thereof such as, for example, random access memory (RAM), read only memory (ROM), flash memory and/or non-volatile RAM (NVRAM). Alternatively, memory 29 may be in the form of a separate electronic memory (e.g., RAM, ROM, and/or NVRAM), a hard drive, a CD or DVD drive, or any memory device convenient for use with controller 28. Controller 28 may be, for example, a combined printer and scanner controller.

In the example embodiment illustrated, controller 28 communicates with print engine 30 via a communications link 50. Controller 28 communicates with imaging unit 32 and processing circuitry 44 thereon via a communications link 51. Controller 28 communicates with toner cartridge 35 and processing circuitry 15 therein via a communications link 52. Controller 28 communicates with media feed system 38 via a communications link 53. Controller 28 communicates with scanner system 40 via a communications link 54. User interface 36 is communicatively coupled to controller 28 via a communications link 55. Processing circuitry 44, 45 may provide authentication functions, safety and operational interlocks, operating parameters and usage information related to imaging unit 32 and toner cartridge 35, respectively. Controller 28 processes print and scan data and operates print engine 30 during printing and scanner system 40 during scanning.

Computer 24, which is optional, may be, for example, a personal computer, including memory 60, such as RAM, ROM, and/or NVRAM, an input device 62, such as a keyboard and/or a mouse, and a display monitor 64. Computer 24 also includes a processor, input/output (I/O) interfaces, and may include at least one mass data storage device, such as a hard drive, a CD-ROM and/or a DVD unit (not shown). Computer 24 may also be a device capable of communicating with image forming device 22 other than a personal computer such as, for example, a tablet computer, a smartphone, or other electronic device.

In the example embodiment illustrated, computer 24 includes in its memory a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24. One aspect of imaging driver 66 may be, for example, to provide formatted print data to image forming device 22, and more particularly to print engine 30, to print an image. Another aspect of imaging driver 66 may be, for example, to facilitate the collection of scanned data from scanner system 40.

In some circumstances, it may be desirable to operate image forming device 22 in a standalone mode. In the standalone mode, image forming device 22 is capable of functioning without computer 24. Accordingly, all or a portion of imaging driver 66, or a similar driver, may be located in controller 28 of image forming device 22 so as to accommodate printing and/or scanning functionality when operating in the standalone mode.

Print engine 30 includes laser scan unit (LSU) 31, toner cartridge 35, imaging unit 32, and a fuser 37, all mounted within image forming device 22. Imaging unit 32 is removably mounted in image forming device 22 and includes a developer unit 34 that houses a toner reservoir (or toner sump) and a toner delivery system. The toner delivery system includes a toner adder roll that provides toner from the toner sump to a developer roll. A doctor blade provides a metered uniform layer of toner on the surface of the developer roll. Imaging unit 32 also includes a cleaner unit 33 that houses a photoconductive drum and a waste toner removal system. Toner cartridge 35 is also removably mounted in imaging unit 32 in a mating relationship with developer unit 34 of imaging unit 32. An exit port on toner cartridge 35 communicates with an entrance port on developer unit 34 allowing toner to be periodically transferred from a reservoir in toner cartridge 35 to resupply the toner sump in developer unit 34.

The electrophotographic printing process is well known in the art and, therefore, is described briefly herein. During a printing operation, laser scan unit 31 creates a latent image on the photoconductive drum in cleaner unit 33. Toner is transferred from the toner sump in developer unit 34 to the latent image on the photoconductive drum by the developer roll to create a toned image. The toned image is then transferred to a media sheet received in imaging unit 32 from media input tray 39 for printing. Toner remnants are removed from the photoconductive drum by the waste toner removal system. The toner image is bonded to the media sheet in fuser 37 and then sent to an output location or to one or more finishing options such as a duplexer, a stapler or a hole-punch.

Figure 2:
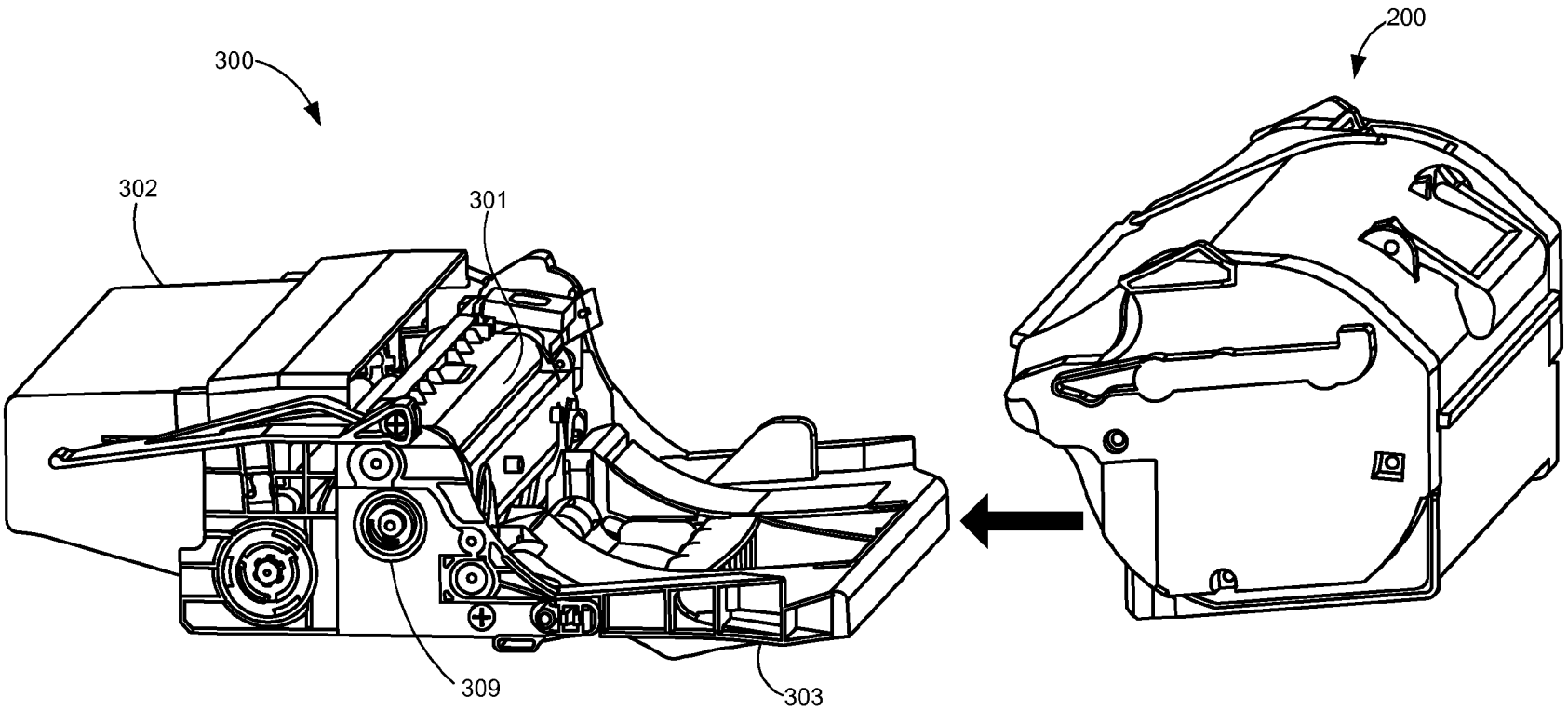
FIG. 2 is a perspective view of a toner cartridge and an imaging unit of FIG. 1 according to one example embodiment.

Referring now to FIG. 2, a toner cartridge 200 and an imaging unit 300 are shown according to one example embodiment. Imaging unit 300 includes a developer unit 301 and a cleaner unit 302 mounted on a common frame 303. As discussed above, imaging unit 300 and toner cartridge 200 are each removably installed in image forming device 22. Imaging unit 300 is first slidably inserted into image forming device 22. Toner cartridge 200 is then inserted into image forming device 22 and onto frame 303 in a mating relationship with developer unit 301 of imaging unit 300 as indicated by the arrow shown in FIG. 2. This arrangement allows toner cartridge 200 to be removed and reinserted easily when replacing an empty toner cartridge without having to remove imaging unit 300. Imaging unit 300 may also be readily removed as desired in order to maintain, repair or replace the components associated with developer unit 301, cleaner unit 302 or frame 303 or to clear a media jam.

Figure 3:
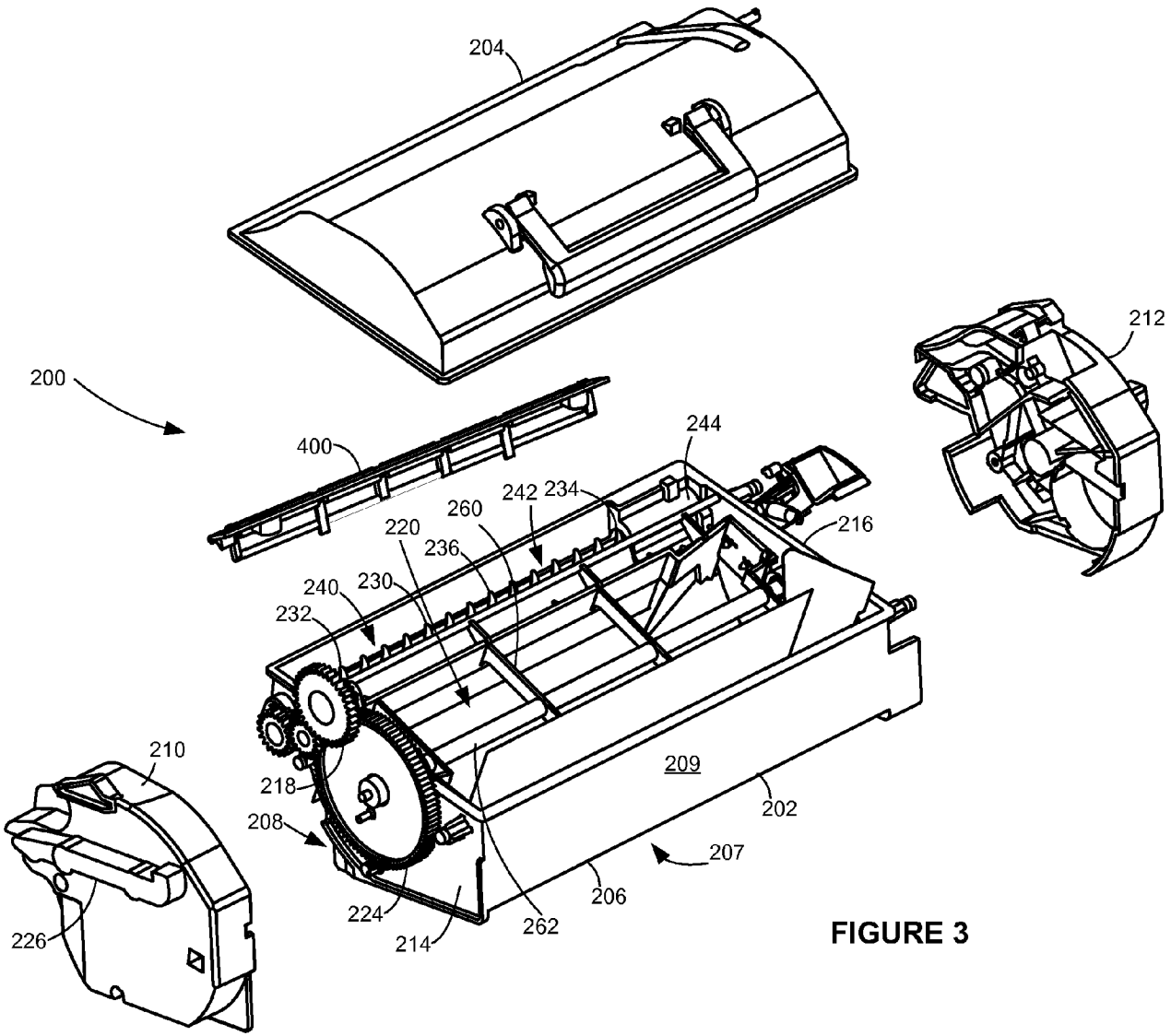
FIG. 3 is an exploded view of the toner cartridge shown in FIG. 2.

Referring now to FIG. 3, toner cartridge 200 includes a housing 202 having an enclosed reservoir 220 for holding a quantity of toner therein. Housing 202 may be viewed as having a top or lid 204 mounted on a base 206. Base 206 is formed by first and second side walls 214, 216 connected to adjoining front and rear walk 208, 209 and bottom 207. In one embodiment, top 204 is ultrasonically welded to base 206 thereby forming enclosed reservoir 220. First and second end caps 210, 212 are mounted to side walls 214, 216, respectively. First and second end caps 210, 212 may be snap fitted into place or attached by screws or other fasteners. First and second end caps 210, 212 each include guides 226 to assist the insertion of toner cartridge 200 into image forming device 22 for mating with developer unit 301, Various gears are housed within a space formed between first end cap 210 and first side wall 214. At least a portion of a main interface gear 218 is exposed between first end cap 210 and first side wall 214 at the front of toner cartridge 200 to allow main interface gear 218 to engage with a drive system in imaging apparatus 22 that provides torque to main interface gear 218. As a result, first side wall 214 may be referred to as the "drive" or "driven" side of toner cartridge 200. Various interlocks and/or linkages may be housed within the space formed between second end cap 212 and second side wall 216. A paddle 260 is rotatably mounted within toner reservoir 220. First and second ends of a drive shaft 262 of paddle 260 extend through aligned openings (not shown) in first and second side walls 214, 216, respectively. A drive gear 224 is provided on the first end of drive shaft 262 that engages with main interface gear 218 either directly or via one or more intermediate gears.

A channel 240 extends along the width of front wall 208 between first and second side walls 214, 216. In one embodiment, channel 240 is positioned above the axis of rotation of drive shaft 262 of paddle 260. Channel 240 may be integrally molded as part of front wall 208 or formed as a separate component attached to front wall 208. Channel 240 is generally horizontal when toner cartridge 200 is installed in image forming device 22. An auger 230 having first and second ends 232, 234, and a spiral screw flight 236 is positioned within and extends along the length of channel 240, First end 232 of auger 230 extends through a bushing 238 (FIG. 6) in first side wall 214. A drive gear (not shown) is positioned on first end 232 of auger 230 that engages with main interface gear 218 either directly or via one or more intermediate gears.

Figure 4:
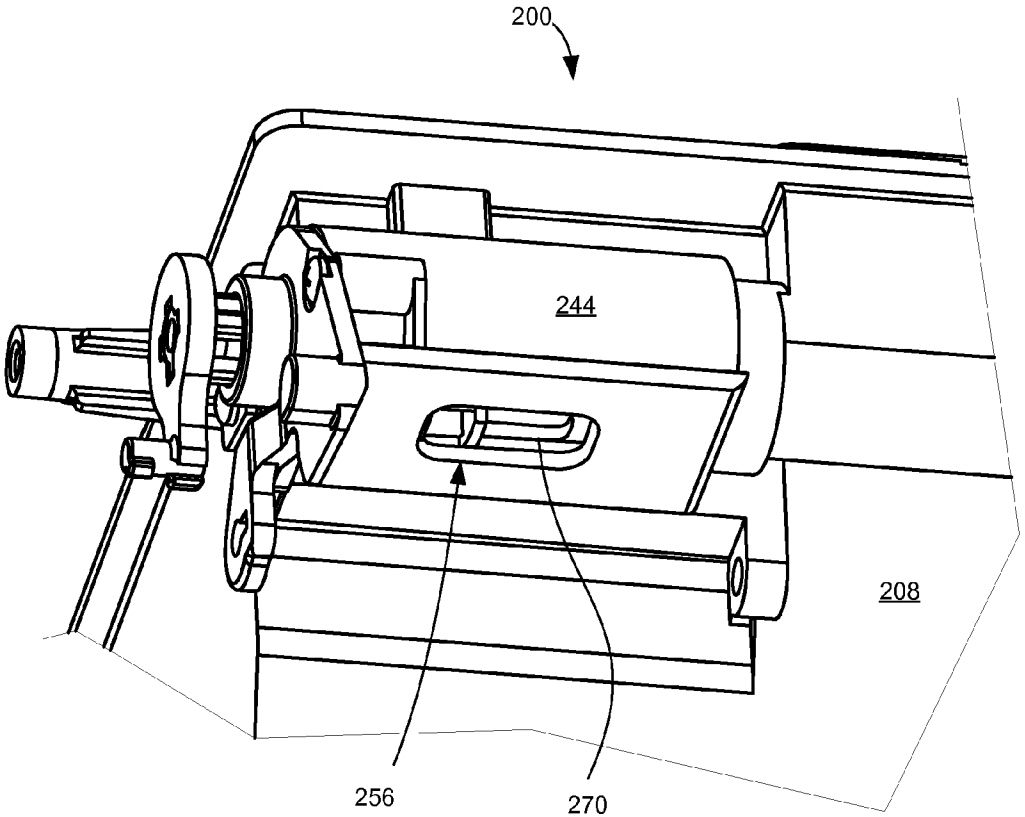
FIG. 4 is a perspective view of a toner exit port of the toner cartridge shown in FIG. 2.

Channel 240 includes an open portion or trough 242 and a substantially enclosed portion 244. Trough 242 is open to toner reservoir 220 and extends from first side wall 214 toward second side wall 216. Enclosed portion 244 of channel 240 extends from second side wall 216 and encloses second end 234 of auger 230. As paddle 260 rotates, it delivers toner from toner reservoir 220 into trough 242. With reference to FIGS. 3 and 4, auger 230 is rotated via the drive gear (not shown) on first end 232 of auger 230 to deliver toner received in channel 240 to a shutter 270 housed in enclosed portion 244 of channel 240. Shutter 270 regulates whether toner is permitted to exit toner cartridge 200 through an exit port 256 provided in front wall 208 and shown in FIG. 4. Exit port 256 is disposed at the bottom of channel 240 so that gravity will assist in exiting toner through exit port 256.

Figure 5:
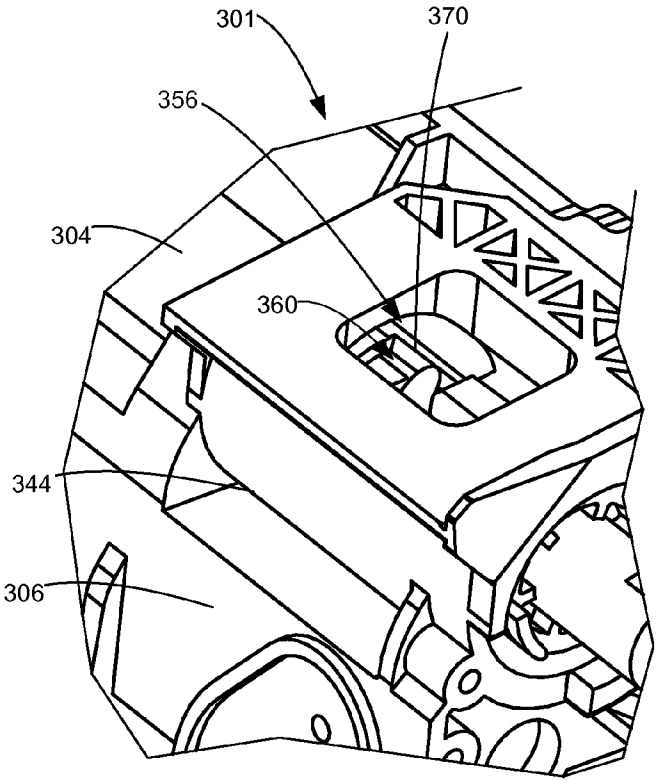
FIG. 5 is a perspective view of a toner entrance port of a developer unit of the imaging unit shown in FIG. 2.
Figure 6:
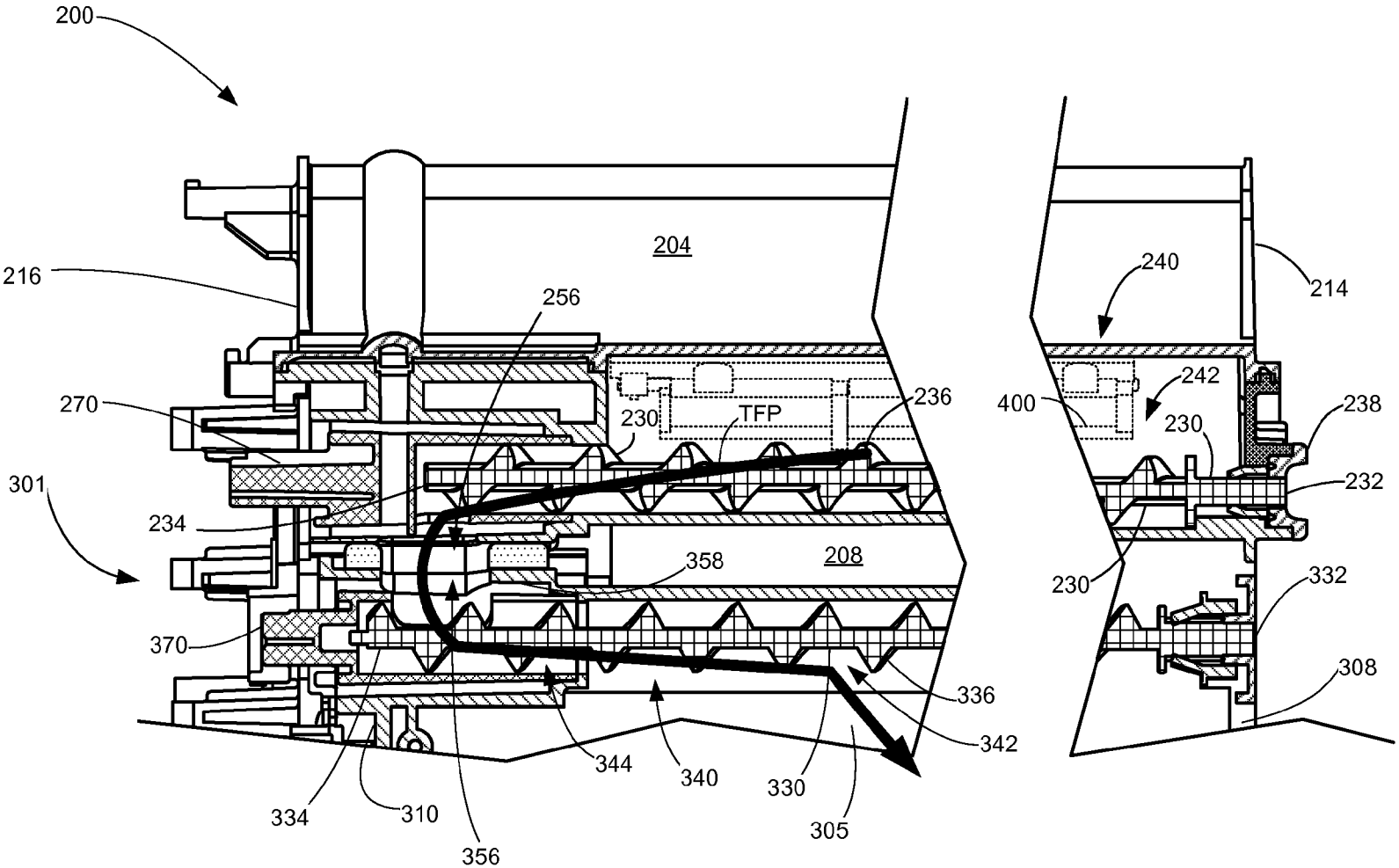
FIG. 6 is a cutaway view of the exit port of the toner cartridge of FIG. 4 in communication with the entrance port of the developer unit of FIG. 5.

With reference to FIGS. 5 and 6, developer unit 301 includes a housing 304 having a toner sump 305 formed by a rear wall 306, first and second side walls 308, 310 and a bottom (not shown). A channel 340 extends along the width of and near the top of rear wall 306. Channel 340 may be integrally molded as part of rear wall 306 or be formed as a separate component attached to rear wall 306. An auger 330 having first and second ends 332, 334, and a spiral screw flight 336 is positioned within and extends along the length of channel 340. First end 332 of auger 330 extends through first side wall 308. A drive gear (not shown) is positioned on first end 332 of auger 330 that engages with an input coupler 309 (FIG. 2) of developer unit 301 either directly or via one or more intermediate gears. Input coupler 309 receives torque at its axial end from a drive system in image forming device 22 to drive various rotatable components in developer unit 301 including auger 330.

Channel 340 includes an open portion or trough 342 and a substantially enclosed portion 344. Trough 342 is open to toner sump 305 and extends from first side wall 308 toward second side wall 310. Enclosed portion 344 of channel 340 extends from second side wall 310 and encloses second end 334 of auger 330. An entrance port 356 is provided through a wall 358 of enclosed portion 344 of channel 340. Entrance port 356 of developer unit 301 aligns with exit port 256 of toner cartridge 200 when toner cartridge 200 is installed on frame 303 and mated with imaging unit 300. As illustrated in FIG. 5, entrance port 356 is disposed at the top of enclosed portion 344 of channel 340 so that gravity will assist toner entry into developer unit 301. In one example form, entrance port 356 is larger in area than exit port 256 to prevent bridging by the toner exiting toner cartridge 200 and entering developer unit 301.

A shutter 370 positioned in enclosed portion 344 of channel 340 regulates whether toner is permitted to enter developer unit 301 through entrance port 356. Second end 334 of auger 330 extends into shutter 370 allowing auger 330 to distribute the incoming toner along channel 340. Trough 342 includes a plurality of openings (not shown) spaced along its length. The openings extend through a bottom portion of trough 342. Auger 330 is rotated via the drive gear on first end 332 of auger 330 to distribute toner received from exit port 256 of toner cartridge 200 along the length of trough 342. The openings in trough 342 allow incoming toner to be distributed substantially evenly into toner sump 305. Channel 340 is disposed above toner sump 305 allowing the entering toner to drop into toner sump 305.

FIG. 6 illustrates the toner flow path (shown as the solid arrow labeled "TFP") between toner cartridge 200 and developer unit 301. In operation, toner is first passed from reservoir 220 to channel 240 by paddle 260. Auger 230 then advances the toner through shutter 270 and out exit port 256. The toner falls via gravity from exit port 256 into entrance port 356 of developer unit 301. The toner is passed through shutter 370 and distributed along channel 340 by auger 330. The toner then drops through the openings in trough 342 into toner sump 305 where it is held for use by developer unit 301. Shutters 270, 370 of toner cartridge 200 and developer unit 301 are moved from closed positions to open positions as toner cartridge 200 is mated with imaging unit 300 to allow toner to flow from toner cartridge 200 to developer unit 301. Shutters 270, 370 are moved from open positions to closed positions as toner cartridge 200 is separated from imaging unit 300 in order to prevent toner leakage from toner cartridge 200 or developer unit 301.

Figure 7:
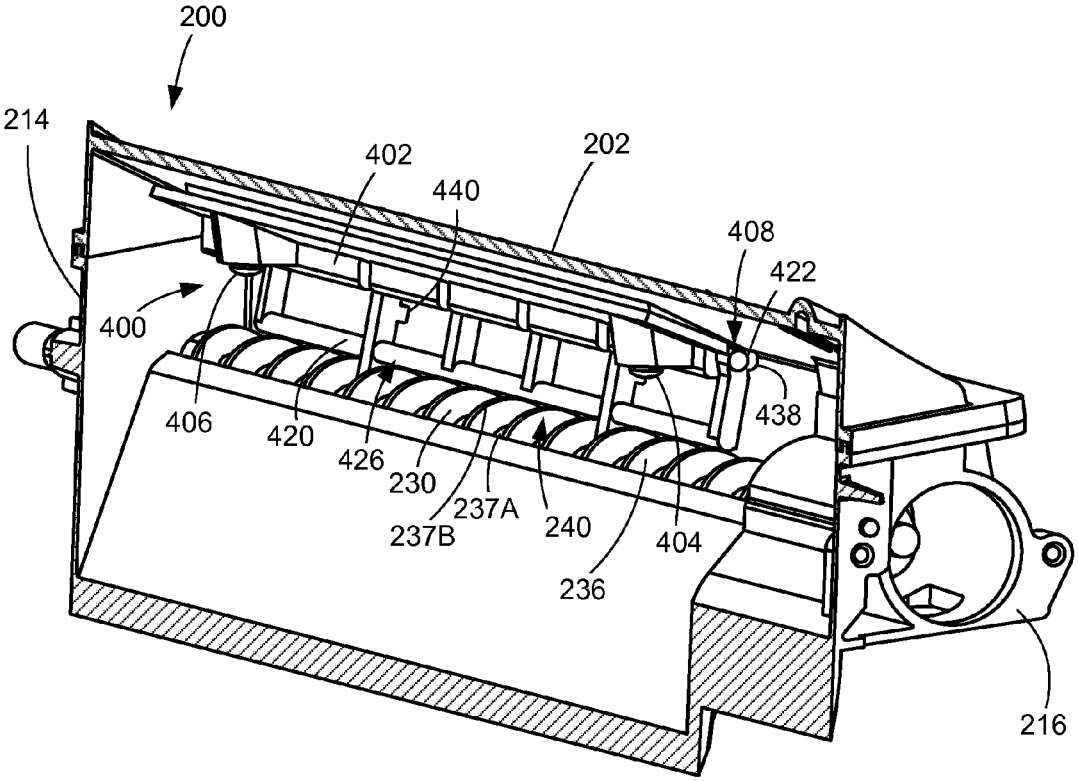
FIG. 7 is a cutaway view of an agitator assembly positioned above an auger of the toner cartridge according to one example embodiment.

As discussed above, toner under high temperature storage or shipping conditions may tend to clump or bridge in channels 240, 340 above augers 230, 330. In some instances, the clumped or bridged toner may block additional toner from being transported through channel 240 or channel 340 potentially causing toner starvation. To address this potential problem, an agitator is provided in channel 240 of toner cartridge 200 and/or channel 340 of developer unit 301 to break up any clumped toner. FIG. 7 shows an example agitator assembly 400. Agitator assembly 400 includes a base 402 that mounts to an inner surface of housing 202 above channel 240 as shown in FIG. 7, Agitator assembly 400 may also be provided in developer unit 301 as desired by mounting base 402 to an inner surface of housing 304 above channel 340.

Figure 8:
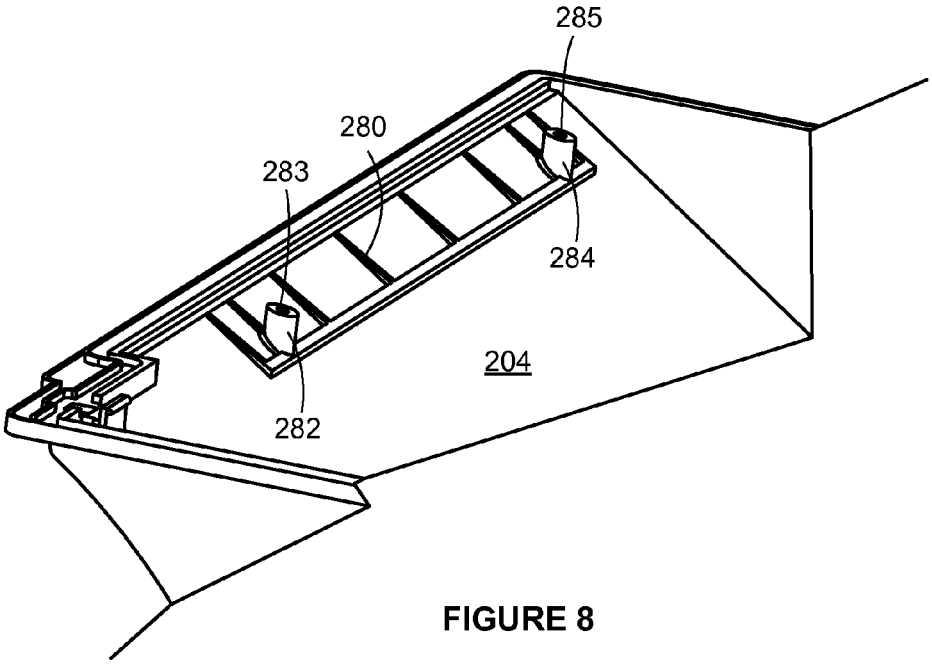
FIG. 8 is a perspective view of a lid of the toner cartridge having features to facilitate the mounting of the agitator assembly shown in FIG. 7.

With reference to FIG. 8, in one embodiment, the inner surface of lid 204 of housing 202 includes a series of ribs 280 that support base 402 of agitator assembly 400. In this embodiment, the inner surface of lid 204 also includes bosses 282, 284 each having a fastener hole 283, 285 therein to facilitate the mounting of base 402 to lid 204. For example, FIG. 7 shows base 402 mounted to lid 204 using fasteners such as screws 404, 406 mounted in fasteners holes 283, 285 in bosses 282, 284, respectively, shown in FIG. 8. It will be appreciated that more than two fasteners and corresponding bosses may be used as needed to provide additional support. Further, base 402 may be mounted to housing 304 of developer unit 301 using a similar arrangement as desired. Base 402 may also be mounted to the inner surface of front wall 208 of base 206 as desired. It will also be appreciated that base 402 may be mounted to housing 202 or housing 304 by any other suitable method such as, for example, by an adhesive applied between base 402 and housing 202 or housing 304, by a snap fit engagement between base 402 and housing 202 or housing 304 or by forming base 402 integrally with housing 202 or housing 304.

Figure 9:
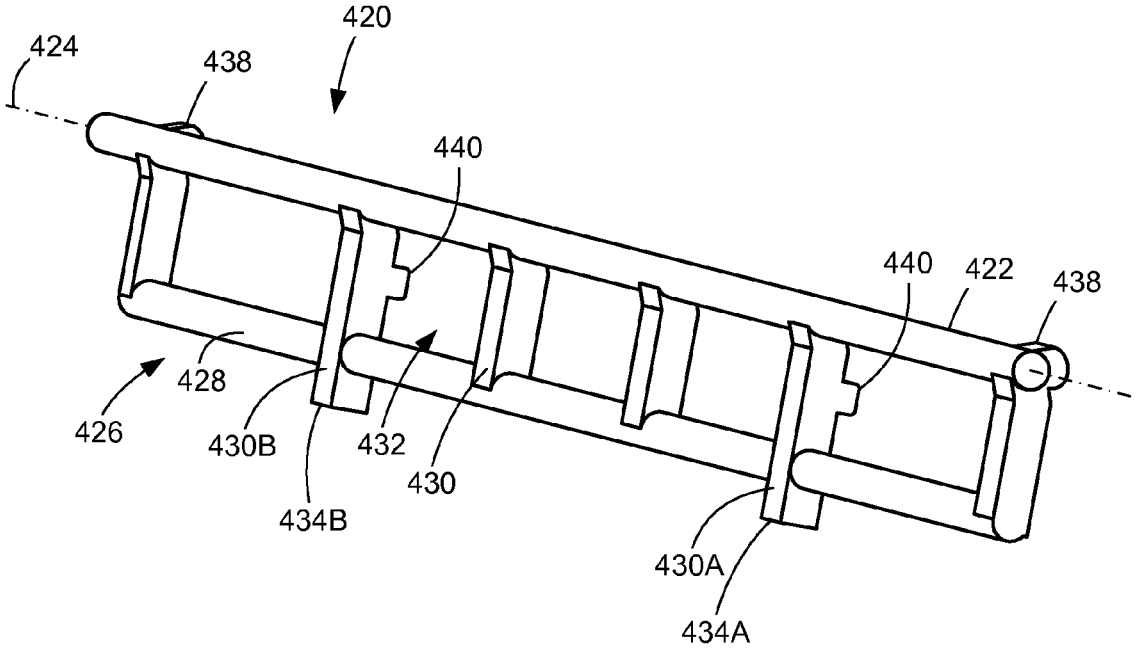
FIG. 9 is a perspective view of an agitator of the agitator assembly shown in FIG. 7.

With reference to FIGS. 7 and 9, agitator assembly 400 includes an agitator 420 pivotally mounted on base 402. Agitator 420 includes a shaft 422 that is rotatably positioned within an elongated channel 408 in base 402. Channel 408 provides a bearing surface to allow rotation of shaft 422. The centerline of shaft 422 forms a pivot axis 424 of agitator 420. One or more agitating members 426 extend from shaft 422 toward auger 230 or auger 330. For example, in the embodiment illustrated, agitating member(s) 426 include a bar 428 and one or more extensions or beams 430 connecting bar 428 to shaft 422. In one embodiment, bar 428 is substantially parallel to shaft 422. Beams 430 provide strength and structural support for bar 428. Gaps or windows 432 are formed between beams 430, shaft 422 and bar 428. Agitator 420 also includes one or more cams 434 that ride on the flight 236 of auger 230 or flight 336 of auger 330 causing agitator 420 to pivot back and forth about pivot axis 424 as auger 230 or auger 330 rotates to break up compacted toner. In the example embodiment illustrated, cams 434 extend from bar 428 toward auger 230 or auger 330. In this embodiment, cams 434A, 434B are formed as extensions from beams 430A, 430B; however, one or more cams 434 may extend from bar 428 separate from beams 430 as desired.

Figure 10:
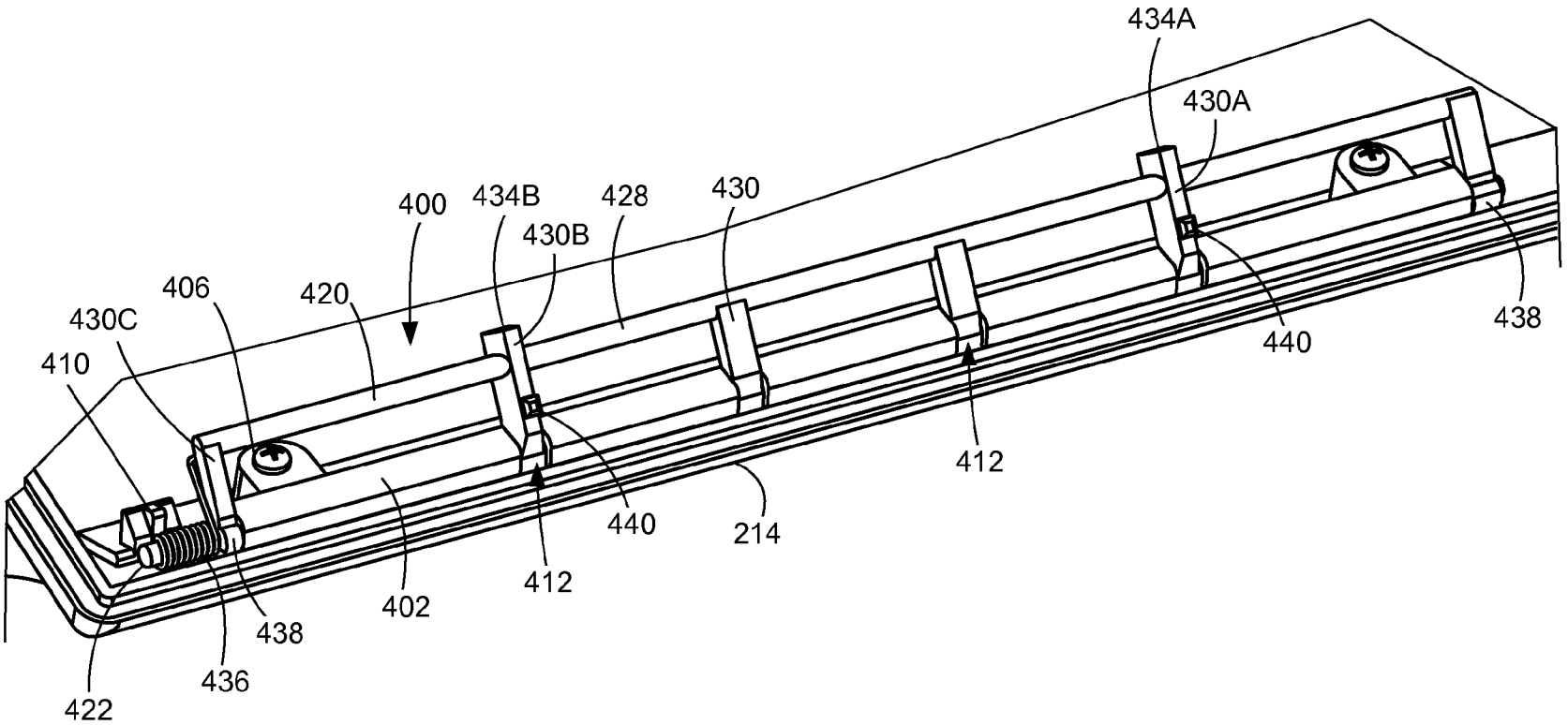
FIG. 10 is a perspective view of the agitator assembly shown in FIG. 7 mounted to the lid shown in FIG. 8 showing a torsion spring for biasing the agitator to a home position according to one example embodiment.

With reference to FIGS. 9 and 10, agitator 420 is biased by a biasing member toward a home position where cam(s) 434 are positioned in the roots 237A of flight 236 of auger 230 (or flight 336 of auger 330) (FIG. 7). In the example embodiment illustrated, the biasing member includes a torsion spring 436 wrapped around shaft 422 and anchored against a nearby beam 430C and a post 410 on base 402 as shown in FIG. 10. FIG. 10 also illustrates a plurality of slots 412 in base 402 each corresponding with one of the beams 430 of agitator 420. Slots 412 provide clearance for beams 430 to allow agitator 420 to pivot when actuated by auger 230 or auger 330.

Figure 11:
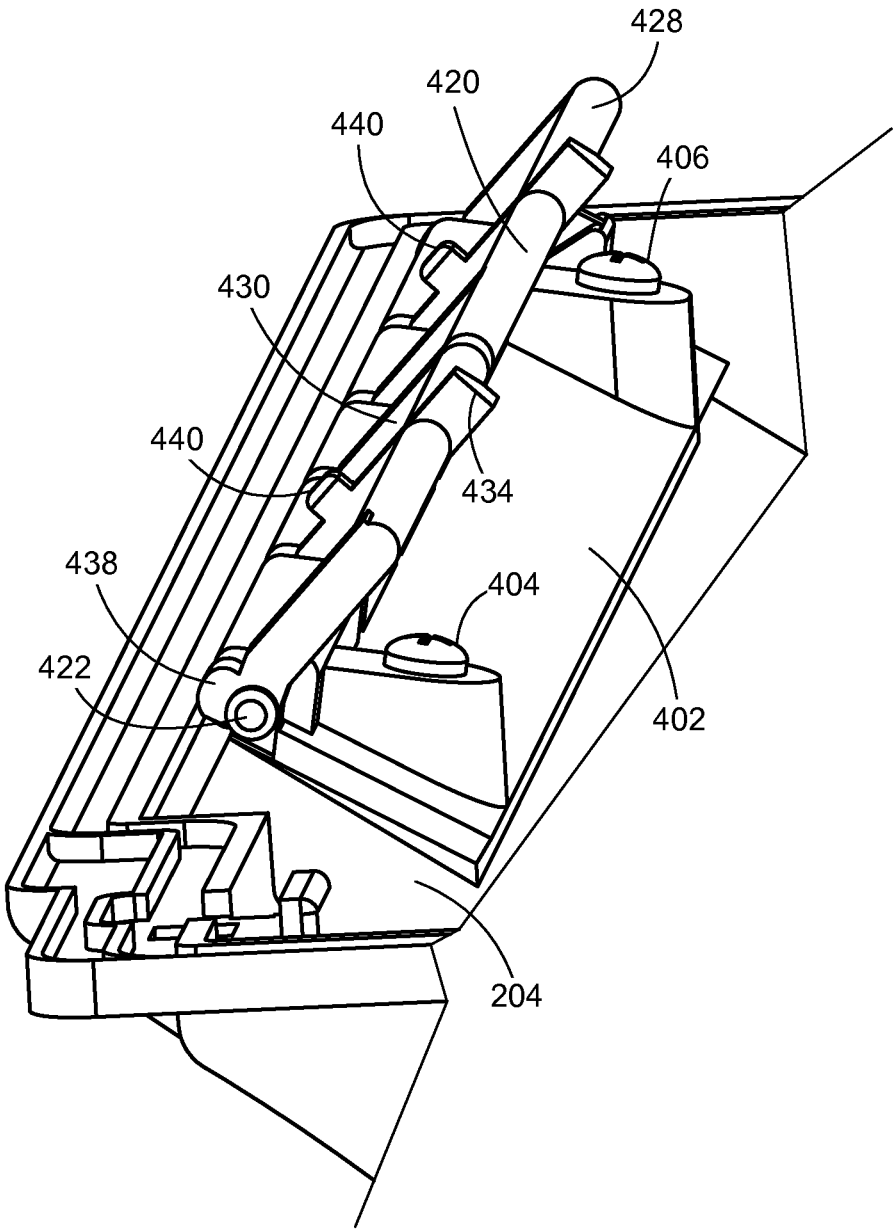
FIG. 11 is a perspective view of the agitator assembly shown in FIG. 7 mounted to the lid shown in FIG. 8 showing stops on the agitator defining the home position of the agitator according to one example embodiment.

With reference to FIGS. 9-11, agitator 420 includes one or more stops 438 that engage with the inner surface of housing 202 or housing 304 to define the home position of agitator 420. In the example embodiment illustrated, stops 438 extend from shaft 422 near one or both of the ends of shaft 422. In this embodiment, stops 438 are positioned near pivot axis 424 of shaft 422 where the velocity of agitator 420 is lowest. This reduces the change in acceleration of agitator 420 as it stops to reduce the noise associated with stops 438 contacting the inner surface of housing 202 or housing 304. Stops 440 may also be provided on one or more of beams 430 proximate to the inner surface of housing 202 or housing 304. Stops 440 may be used in place of stops 438 or as a backup to stops 438 in case stops 438 become damaged and fail.

Figure 12:
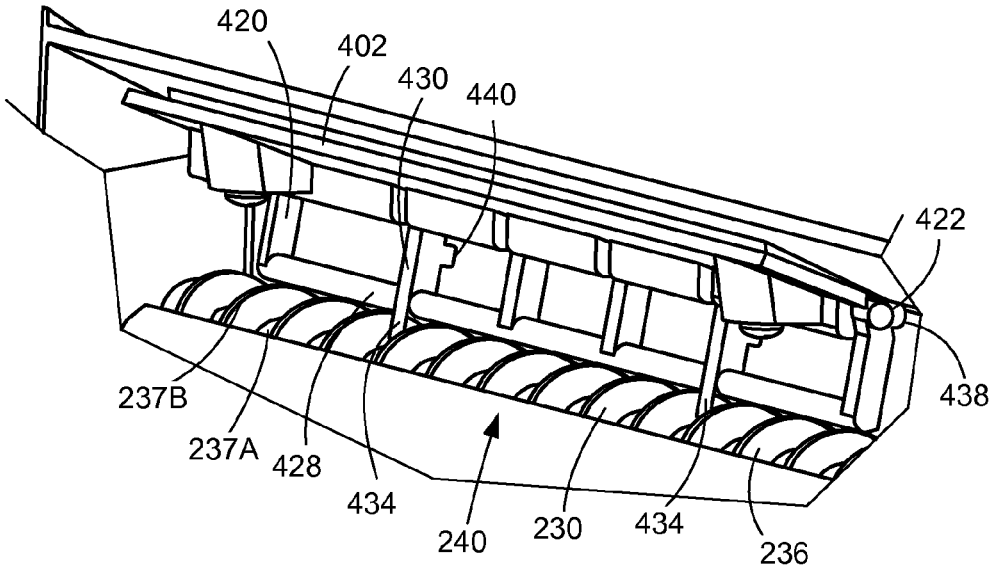
FIGS. 12 and 13 show cutaway views of the agitator assembly shown in FIG. 7 at different moments of operation.
Figure 13:
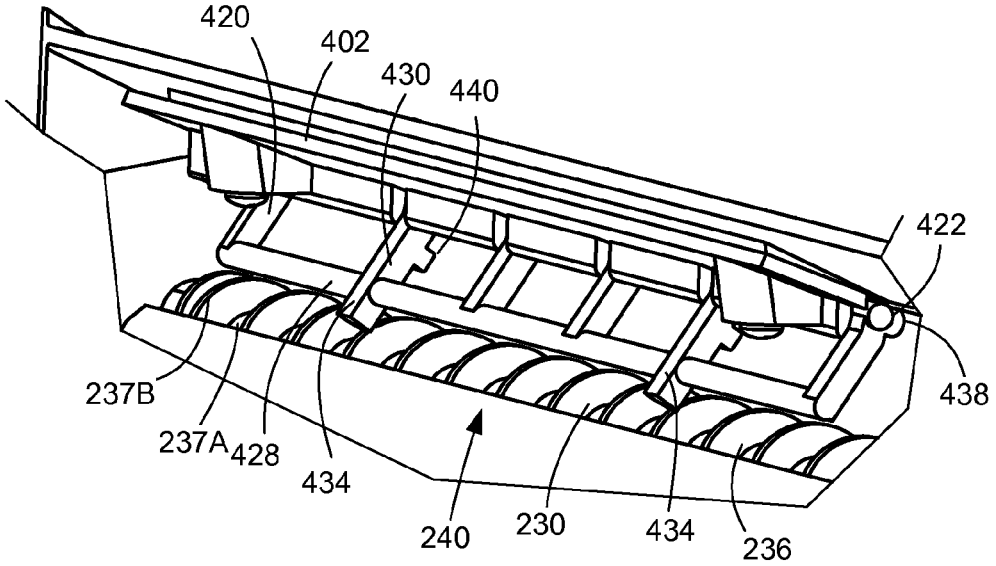

FIGS. 12 and 13 illustrate the operation of agitator 420. As auger 230 rotates to move toner along channel 240 (to the right as viewed in FIGS. 12 and 13), cams 434 ride up and down the crests 237B and roots 237A of flight 236 causing agitator 420 to pivot back and forth about pivot axis 424. FIG. 12 shows agitator 420 in the home position with cams 434 positioned in the root 237A of flight 236 of auger 230 and contacting the rear side of auger 230 (i.e., the side of auger facing rear wall 209). As auger 230 rotates, cams 434 ride up the crests 237B of flight 236 pushing cams 434 rearward and upward (as defined by rear wall 209 and lid 204 of housing 202) as shown in FIG. 13. This causes agitator 420 to pivot about pivot axis 424 away from the home position compressing spring 436 and moving bar 428 rearward and upward above channel 240. As auger 230 continues to rotate, cams 434 ride down crests 237B toward roots 237A as a result of the bias applied by spring 436 causing agitator 420 to return to the home position. The oscillating movement of agitator 420 helps to break up any toner compacted above auger 230 in channel 240 (or auger 330 in channel 340). In the example embodiment illustrated, bar 428 and beams 430 break up compacted or bridged toner while windows 432 allow agitator 420 to sweep through the toner.

Figure 14A:
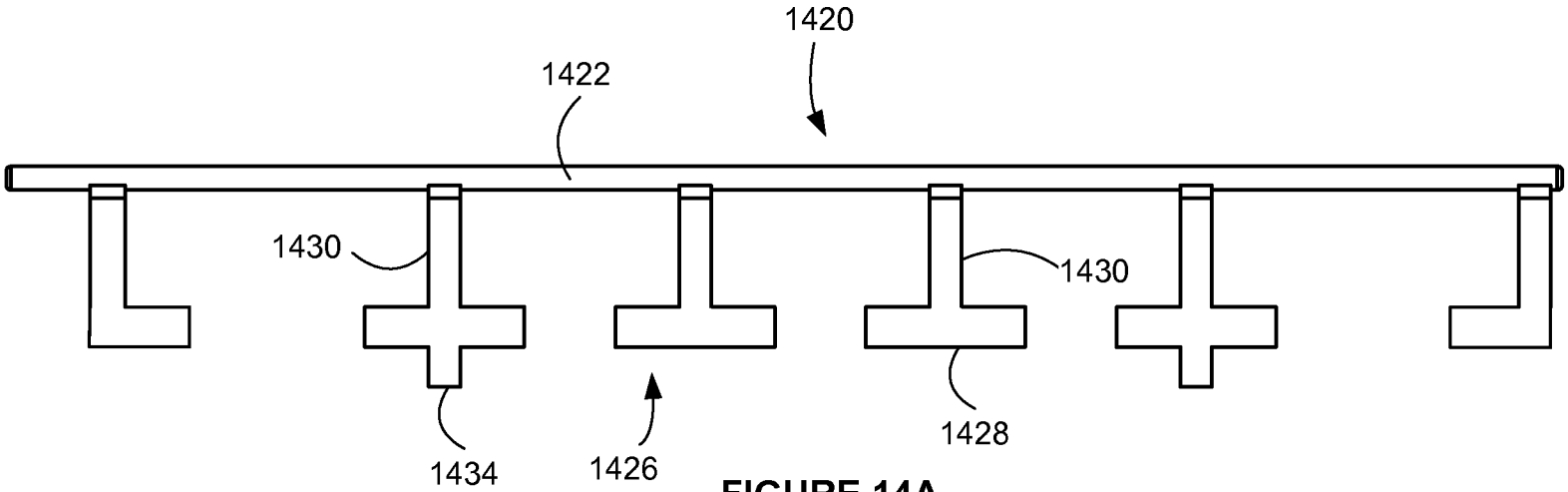
FIG. 14A is a plan an agitator according to a second example embodiment.
Figure 14B:
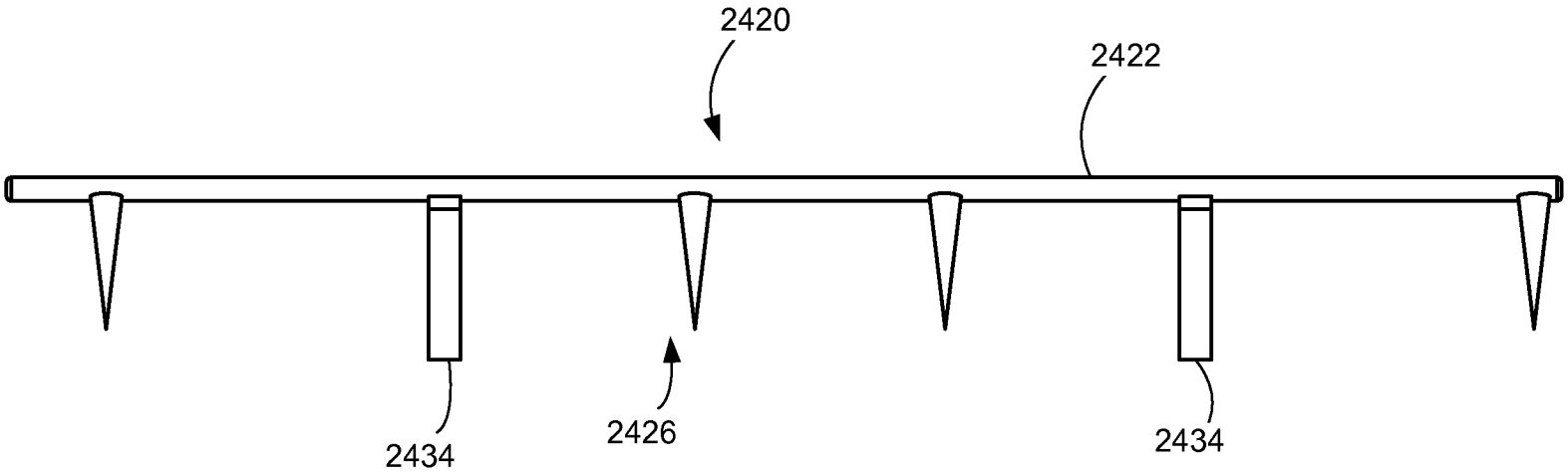
FIG. 14B is a plan view of an agitator according to a third example embodiment.

Of course it will be appreciated that agitator assembly 400 may take many shapes and forms as desired. For example, FIG. 14A shows an agitator 1420 according to another example embodiment. Agitator 1420 includes a series of T-shaped structures 1426 extending from a shaft 1422. Each T-shaped structure 1426 includes an extension or beam 1430 extending from shaft 1422 and an extension such as a bar segment 1428 that extends from beam 1430 in a substantially parallel orientation with shaft 1422. One or more cams 1434 extend from T-shaped structures 1426 to engage auger 230 or auger 330 as discussed above. FIG. 14B shows another example agitator 2420 that includes a series of axially spaced blades 2426 extending from shaft 2422. One or more of the blades 2426 may serve as cams 2434. Alternatively, blades 2426 may have extensions therefrom that serve as cams 2434. It will be appreciated that the agitating members of the agitator may be of other various geometrical shapes such as, for example, substantially cylindrical, rectangular, triangular, conical, etc., and may be of different lengths and/or dimensions, or angular orientations with respect to each other or relative to shaft 422.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

What is claimed is:

1. A removable unit for an electrophotographic image forming device, comprising:

a housing having an inner volume forming a toner reservoir and a channel for accumulating toner;

an auger for advancing toner within the channel, the auger having a rotational axis and a flight; and an agitator pivotally mounted within the toner reservoir, the agitator having at least one agitating member extending near the auger and a cam surface operatively connected to the at least one agitating member and positioned to engage the auger, wherein when the auger rotates, the flight of the auger engages the cam surface causing pivotal movement of the agitator to move the at least one agitating member to agitate toner accumulated near the auger, wherein the agitator includes a rotatable shaft, an axis of rotation of the shaft defining a pivot axis of the agitator, and the at least one agitating member includes a plurality of extensions from the shaft, wherein the at least one agitating member further includes a bar extending between and connected to at least two of the plurality of extensions and the bar is connected to the shaft by the extensions, wherein the agitator is biased toward a home position and includes a stop positioned to contact a portion of the housing when the agitator is in the home position and when the auger rotates, the flight of the auger pivots the agitator away from the home position and the bias returns the agitator to the home position, wherein the agitator includes a rotatable shaft, an axis of rotation of the shaft defining a pivot axis of the agitator and the stop extends directly from the shaft near the axis of rotation.

2. The removable unit of claim 1, wherein the agitator is pivotally mounted to an inner surface of the housing above the channel.

3. The removable unit of claim 1, wherein the bar is substantially parallel to the shaft.

4. The removable unit of claim 1, wherein the at least one agitating member extends over the top of the auger.

5. The removable unit of claim 1, wherein the housing includes a front wall proximate to the channel and a rear wall opposite the front wall and spaced away from the channel and the cam surface engages the auger on a side of the auger facing the rear wall.

6. A toner conveyance assembly for an electrophotographic image forming device, comprising:

a channel for accumulating toner;

an auger for advancing toner within the channel, the auger having a rotational axis and a flight; and an agitator having at least one agitating member extending near the auger and a cam surface operatively connected to the at least one agitating member and positioned to engage the auger, wherein when the auger rotates, the flight of the auger engages the cam surface causing pivotal movement of the agitator to move the at least one agitating member to agitate toner accumulated near the auger, wherein the agitator is biased toward a home position and includes a stop positioned to contact a portion of a housing holding the toner conveyance assembly when the agitator is in the home position and when the auger rotates, the flight of the auger pivots the agitator away from the home position and the bias returns the agitator to the home position, wherein the agitator includes a rotatable shaft, an axis of rotation of the shaft defining a pivot axis of the agitator, and the stop extends directly from the shaft near the axis of rotation.

7. The toner conveyance assembly of claim 6, wherein the at least one agitating member includes a plurality of extensions from the shaft.

8. The toner conveyance assembly of claim 7, wherein the at least one agitating member further includes a bar extending between and connected to at least two of the plurality of extensions and the bar is connected to the shaft by the extensions.

9. The toner conveyance assembly of claim 8, wherein the bar is substantially parallel to the shaft.

10. The toner conveyance assembly of claim 6, wherein the at least one agitating member extends over the top of the auger.

* * * * *